US005868068A

United States Patent [19]

Lee

[11] Patent Number: 5,868,068

[45] Date of Patent: Feb. 9, 1999

[54] ENCLOSED TYPE TWO-STAGE GARBAGE COMPACTION AND STORAGE STRUCTURE

[76] Inventor: Ming-Fong Lee, 2F, No.21, Sec.3, Yen Pin N. Rd., Taipei, Taiwan

[21] Appl. No.: 124,773

[22] Filed: Jul. 30, 1998

[51] Int. Cl.[6] ..... B30B 7/00

[52] U.S. Cl. ..... 100/139; 100/145; 100/177; 100/249; 414/468; 414/502

[58] Field of Search ..... 100/137–139, 100/144, 145, 177, 215, 218, 249; 414/468, 502, 525.6, 526

[56] References Cited

U.S. PATENT DOCUMENTS

| | | | |
|---|---|---|---|
| 2,164,164 | 6/1939 | Price | 100/137 |
| 2,825,478 | 3/1958 | Hunnicutt et al. | 414/468 |
| 3,927,780 | 12/1975 | Dearlove | 414/502 |
| 3,948,167 | 4/1976 | De Feudis | 100/249 |
| 4,257,728 | 3/1981 | Schmidt et al. | 414/468 |
| 4,872,404 | 10/1989 | Quetsch et al. | 100/177 |
| 5,622,103 | 4/1997 | Acosta et al. | 100/249 |

FOREIGN PATENT DOCUMENTS

| | | | |
|---|---|---|---|
| 59198 | 11/1941 | Denmark | 100/139 |
| 2-249803 | 10/1990 | Japan | 100/249 |
| 3-111302 | 5/1991 | Japan | 100/177 |

*Primary Examiner*—Stephen F. Gerrity

[57] ABSTRACT

An enclosed type two-stage garbage compaction and storage structure, in particular a structure having both a hydraulic cylinder and a rotary inner cylinder provided with guide plates to compact garbage in two stages. The structure includes a housing, the hydraulic cylinder, and the inner cylinder. The housing is provided with a plurality of garbage slots to achieve quick collection of garbage. The housing has a front outlet and a lid. A slide plate is provided in front of the front outlet. The hydraulic cylinder is disposed horizontally, and has a piston rod at a front end and a push stop plate connected to the piston rod for pushing dumped-in garbage into the inner cylinder. The inner cylinder has a gate at an entrance thereof and a plurality of guide plates on its inner wall. When the inner cylinder rotates, a compaction effect is generated. The arrangement of a hydraulic cylinder having a greater compression force and a rotary inner cylinder provided with guide plates considerably enhances the compaction and storage of garbage.

1 Claim, 4 Drawing Sheets

ENCLOSED TYPE TWO-STAGE GARBAGE COMPACTION AND STORAGE STRUCTURE

BACKGROUND OF THE INVENTION (a) Field of the Invention

The present invention relates generally to an enclosed type two-stage garbage compaction and storage structure, and more particularly to a compaction and storage structure having both a hydraulic cylinder and a rotary inner cylinder to compact garbage in two stages so as to considerably increase garbage compaction and storage efficiency.

(b) Description of the Prior Art

Garbage disposal is an aggravating problem. It is therefore important to improve existing garbage disposal and storage structures. In densely populated communities where the amount of garbage is considerable, efficient garbage collection and storage structures are necessary.

There has been developed a kind of garbage storage device that utilizes guide plates to achieve garbage compaction. However, since there are different types of garbage, some relatively bulky garbage such as PE bottles and cartons will discount its storage efficiency. There has been later developed a kind of device with cutters for shredding the garbage so as to decrease its overall size and achieve higher storage efficiency. In such a device, garbage is dumped into a cutter device, which cuts the garbage into pieces for storage in a storage tank. The cut garbage is then discharged via an outlet to be removed by a garbage truck. More garbage can be dumped into, cut, and accumulated until the device is saturated. However, there are the following disadvantages with such a device:

1. The cutter device is not effective on larger or harder objects, which will damage the blades. Replacement of the blades is necessary, which adds to the cost and is therefore economically impractical.

2. As the storage tank relies on an inner cylinder with guide plates to compact the garbage, the compaction rate is not good. Besides, using cutters to reduce the size of the garbage is not reliable and economical, hence not suitable for the general users.

There is also available a kind of device that utilizes a hydraulic cylinder with a propeller to compact garbage until the device is saturated. However, although the compaction force of the hydraulic cylinder is large, there are the following disadvantages:

1. Using a hydraulic device as a main power source for garbage compaction will make the hydraulic cylinder and the propeller a large-size device, which requires a very large space and expensive maintenance. This is impractical for small communities, buildings or institutes such as schools.

2. There is only a single garbage slot, which is inconvenient.

3. Once such a device breaks down, repair thereof is costly and time-consuming. Therefore, it is not cost-effective.

SUMMARY OF THE INVENTION

Therefore, a primary object of the present invention is to provide an enclosed type two-stage garbage compaction and storage structure that is simple in construction and has the advantages provided by a hydraulic cylinder having a powerful compaction force and a rotary inner cylinder with guide plates, thus achieving a two-stage compaction and storage effect to increase space utilization and rate of garbage collection.

According to the present invention, the enclosed type two-stage garbage compaction and storage structure comprises a housing, a rotary inner cylinder internally provided with guide plates, and a hydraulic cylinder disposed at a rear side to compact and push garbage into the inner cylinder. One side of the housing is provided with a plurality of garbage slots, the other side thereof being provided with a garbage outlet having a lid. The garbage outlet has a slide plate disposed in front thereof for guiding the garbage into the garbage truck. When garbage is dumped in, the hydraulic cylinder presses and pushes it into the inner cylinder, which rotates while compacting the garbage. The inner cylinder has a gate at an entrance thereof to prevent reverse flow of garbage.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
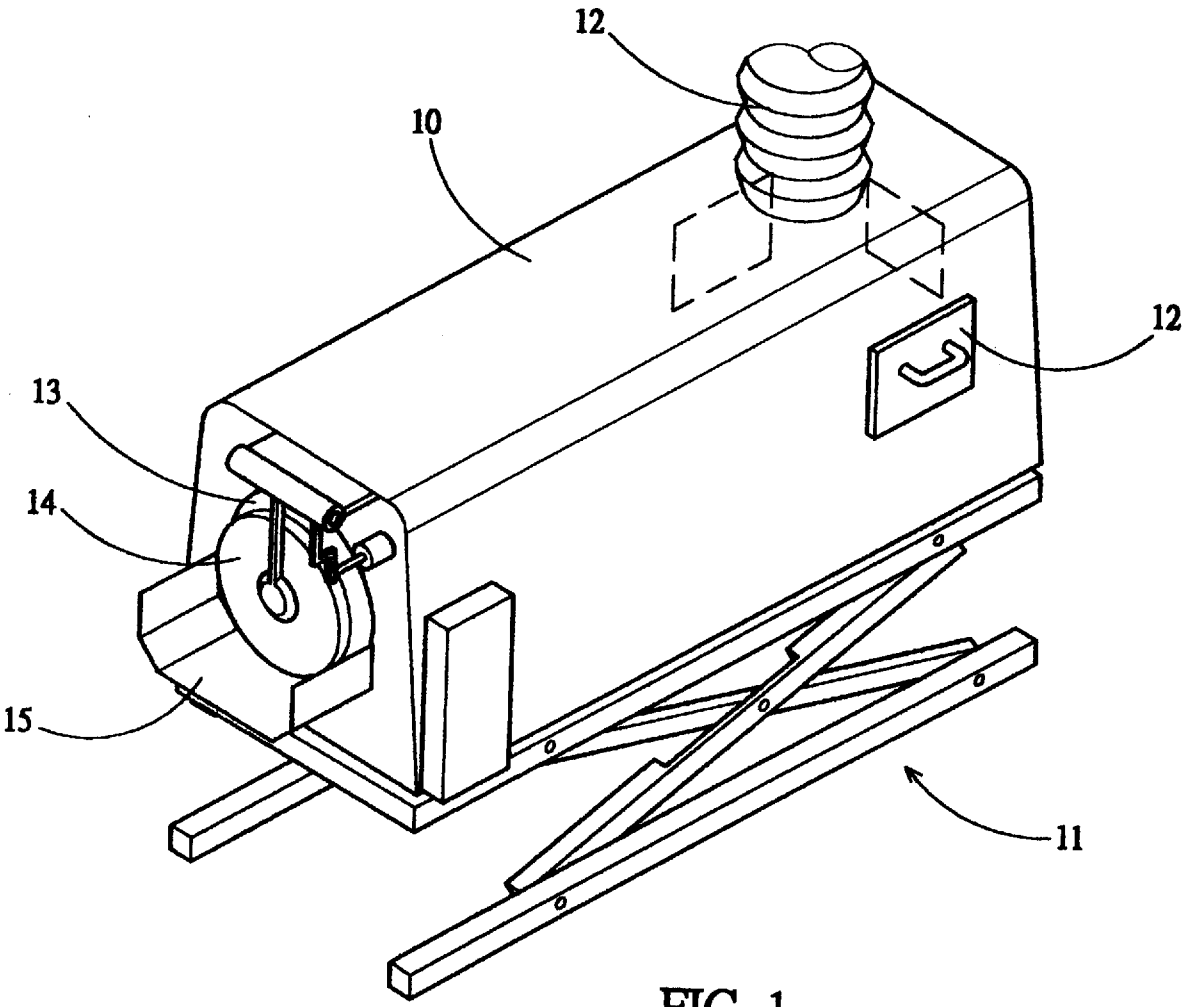
FIG. 1 is a schematic view of the exterior of the present invention.

With reference to FIG. 1, which is a schematic of the exterior structure of the present invention, an improved enclosed type two-stage garbage compaction and storage structure comprises a housing 10 that is an elongate cylinder structure having a hydraulic elevatable leg support 11 to facilitate adjustment of the height of the major structure of the body, and a plurality of garbage slots 12 respectively provided on a rear end of a section as well as left and right sides and an upper side of the body to facilitate dumping of garbage into the body or into a garbage truck. The garbage slot 12 on the upper side is connected to upper floors of a building by a creased retractable tube so that the present invention can be adapted to receive garbage from different floors. The plurality of garbage slots 12 increases the rate of garbage collection. The housing 10 further has an outlet 13 and a lid 14 at a front end thereof. The front of the outlet 13 is provided with a slide plate 15 such that, when the lid 14 is lifted, garbage from the outlet can slide down the slide plate 15 into the garbage truck.

Figure 2:
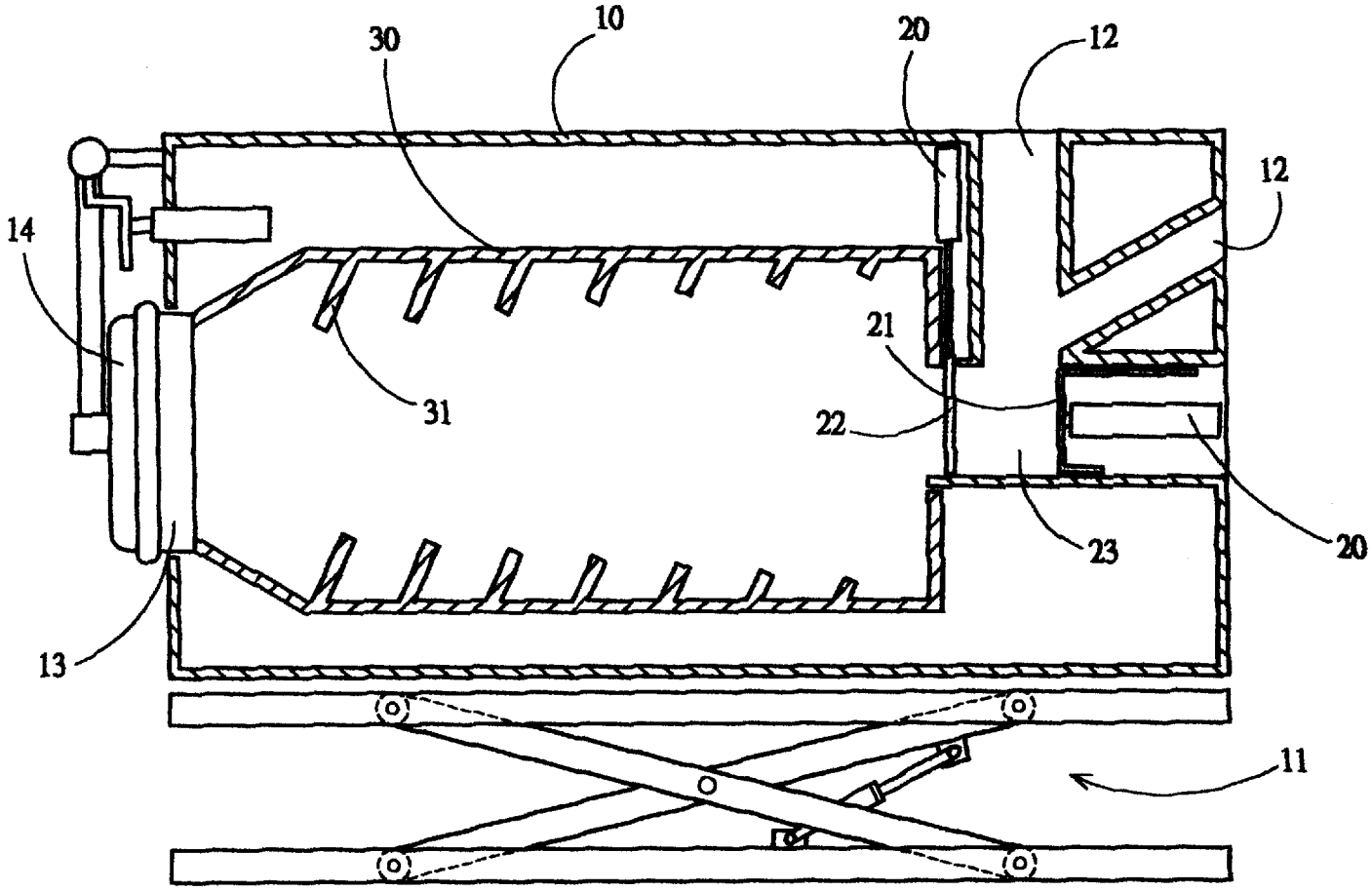
FIG. 2 is a schematic view of the interior structure of the present invention.

Referring to FIG. 2, which shows the interior structure of the present invention, comprising a hydraulic cylinder 20 and inner cylinder 30. The hydraulic cylinder 20 is transverse disposed and has a piston rod at a front end connecting to a push stop plate 21. The push stop plate 21 is used to push dumped-in garbage into the inner cylinder 30 and can prevent entry of additional garbage during the process of pushing by the hydraulic cylinder 20.

The inner cylinder 30 is internally provided with guide plates 31 that can generate a compaction effect during rotation of the inner cylinder. In addition, there is a drive motor and a power transmission device for driving the inner cylinder 30. Rollers are provided on the outer side of the inner cylinder 30 at the corners and are insertably retained in limiting recessed rings (not shown) on an inner side of the housing 10, so that they will not deviate during rotation. As this is well known in the art, it will not be discussed in detail herein.

Figure 3:
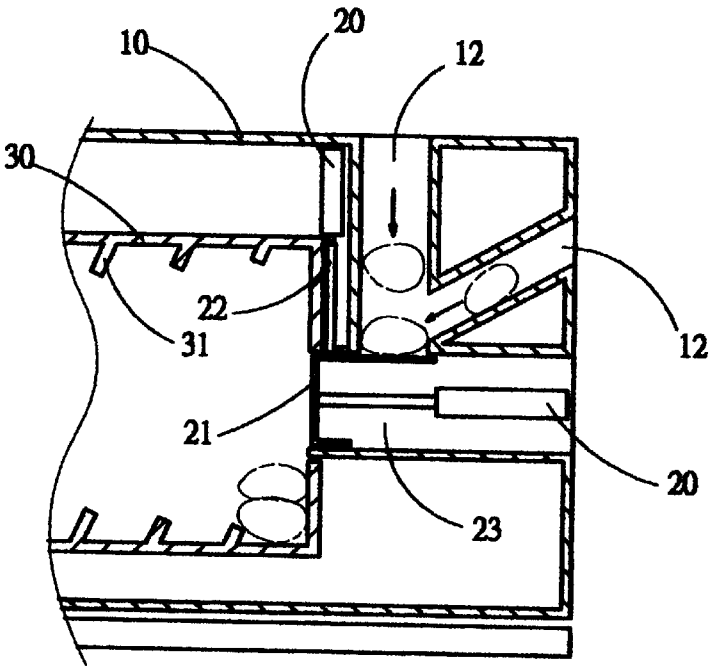
FIGS. 3A and 3B are schematic views illustration operation of the present invention.
Figure 3:
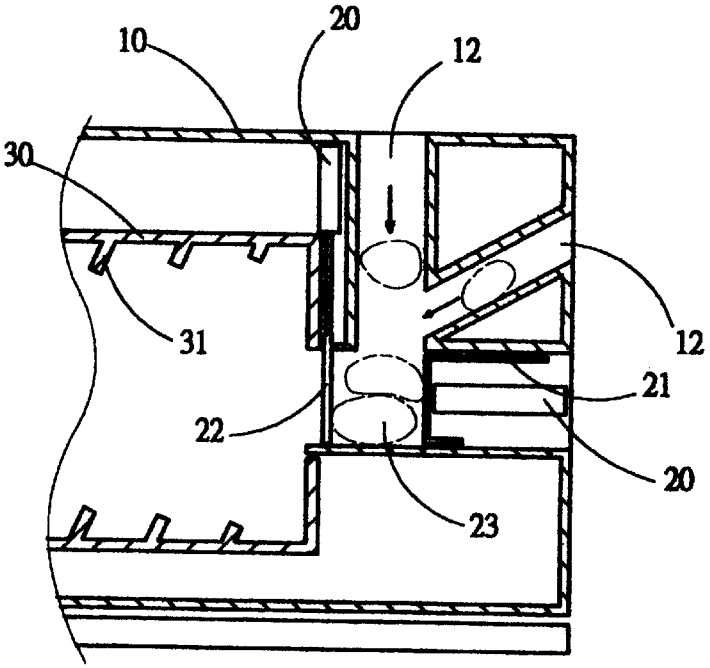

Operation of the present invention is hereinafter described with reference to the drawings. Garbage is dumped in via the garbage slot 12 on the upper side into the interior of the housing 10. Garbage is also collected via the garbage slots 12 on the rear side as well as the left and right sides to increase the garbage collection rate. The garbage falls in the position of the hydraulic cylinder 20. As shown in FIG. 3A, the piston rod of the hydraulic cylinder 20 is in a retracted state, and the garbage may enter a compaction channel where the hydraulic cylinder 20 is located via the garbage slots 12. The garbage is collectively collected in front of the push stop plate 21 of the hydraulic cylinder 20. At this time, a gate at the entrance to the inner cylinder 30 is also closed, so as to prevent the garbage in the inner cylinder 30 from flowing out in a reverse direction. When the hydraulic cylinder 20 is actuated so that it pushes forwardly, as shown in FIG. 3B, the gate 22 opens and the push stop plate 21 of the hydraulic cylinder 20 moves forwardly to compact the garbage and closes the garbage channel of the garbage slots 12. This prevents entry of additional garbage into the housing 10 behind the push stop plate 21 to cause damage during the process of compaction by the hydraulic cylinder 20. This is therefore a protection arrangement. When garbage is pushed into the inner cylinder 30, the inner cylinder 30 rotates to bring the garbage forward. The garbage is compacted and pushed forward by the guide plates 31 inside the inner cylinder 30. When the push stop plate 21 of the hydraulic cylinder retracts, the gate 22 is closed, thus returning to the state as shown in FIG. 3A. The next compaction operation can then proceed. Since the inner cylinder 30 is a cylindrical structure, the guide plates 31 on the inner side thereof can generate a compaction effect during rotation of the inner cylinder. A double compaction effect is therefore achieved.

Figure 4:
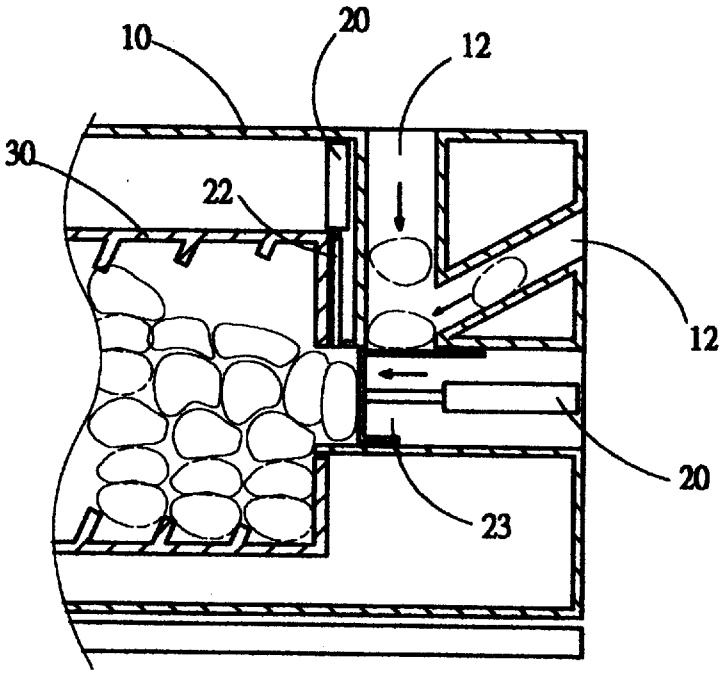
FIG. 4 is a schematic view illustrating operation of the present invention when handling a greater quantity of garbage.

Reference is made to FIG. 4, which shows the present invention for use in storing larger amounts of garbage. As the present invention has a two-stage compaction action, it can store more garbage than the prior art. When the garbage in the inner cylinder 30 is saturated, an indicating light on the housing 10 will be on to inform the concerned personnel to clean up. At this time, by lifting the lid 14, the inner cylinder 30 will start rotating to discharge the garbage inside, and the garbage will slide down the slide plate 15 into the garbage truck, which further compacts the garbage. Then the lid 14 can be closed and the present invention can start operation again.

In summary, aside from having a plurality of garbage slots, the present invention is provided with a rotary inner cylinder having compacting guide plates and a hydraulic cylinder having a powerful compaction effect. Compared to conventional garbage collecting and storage devices using only a hydraulic device, the present invention is more compact in size and easy to maintain while considerably enhancing garbage collection efficiency. It can therefore be appreciated that the present invention can eliminate the problems of the prior art.

Although the present invention has been illustrated and described with reference to the preferred embodiment thereof, it should be understood that it is in no way limited to the details of such embodiment but is capable of numerous modifications within the scope of the appended claims.

What is claimed is:

1. An enclosed type two-stage garbage compaction and storage structure, comprising:

an inner cylinder that is provided with a plurality of guide plates along an inner wall thereof in a longitudinal direction so as to generate a compaction effect during rotation of said inner cylinder, said inner cylinder being provided with an openable and closable gate at an entrance thereof, a hydraulic cylinder that is horizontally disposed, and has a piston rod at a front end thereof and a push stop plate connected to said piston rod for pushing and pressing garbage dumped into said structure into said inner cylinder;

a drive motor and power transmission device for rotating the inner cylinder; and wherein when said piston rod of said hydraulic cylinder is in a retracted state, the garbage is dumped in via channels of garbage slots of said structure into a compaction channel where said hydraulic cylinder is located, and the garbage is collectively collected in front of said push stop plate of said hydraulic cylinder, while said gate at said entrance of said inner cylinder is in a closed state to prevent reverse flow of garbage; and when said hydraulic cylinder pushes forwardly, said gate is opened and said push stop plate of said hydraulic cylinder also presses forward while said garbage channels of said garbage slots are closed to prevent additional garbage from entering a rear side of said stop plate to cause damage to said hydraulic cylinder during its return stroke in the process of compaction by said hydraulic cylinder, the garbage being subsequently pushed into said inner cylinder which rotates to further compact the garbage.

* * * * *